US009757637B1

(12) United States Patent
Glaser

(10) Patent No.: US 9,757,637 B1
(45) Date of Patent: Sep. 12, 2017

(54) BASKETBALL TRAINING APPARATUS

(71) Applicant: Kevin Glaser, St. Petersburg, FL (US)

(72) Inventor: Kevin Glaser, St. Petersburg, FL (US)

( * ) Notice: Subject to any disclaimer, the term of this patent is extended or adjusted under 35 U.S.C. 154(b) by 129 days.

(21) Appl. No.: 14/708,222

(22) Filed: May 9, 2015

(51) Int. Cl.
*A63B 69/00* (2006.01)

(52) U.S. Cl.
CPC .. *A63B 69/0071* (2013.01); *A63B 2208/0204* (2013.01)

(58) Field of Classification Search
USPC ..... 473/447
See application file for complete search history.

(56) References Cited

U.S. PATENT DOCUMENTS 3,160,307 A * 12/1964 Morrison ..... B65D 11/1873 165/135
3,266,656 A * 8/1966 Kridle ..... B65D 9/12 220/4.28
5,324,026 A * 6/1994 Conlon ..... A63B 69/0071 473/450
6,299,570 B1 * 10/2001 Lim ..... A63B 21/00047 434/248
8,277,340 B1 * 10/2012 Devine ..... A63B 69/0071 473/422
2004/0195790 A1 * 10/2004 Wong Hahn ..... B25H 1/12 280/47.19
2007/0202969 A1 * 8/2007 Girard ..... A63B 47/002 473/447
2008/0128306 A1 * 6/2008 Bateman ..... A47F 13/00 206/391
2009/0071923 A1 * 3/2009 Wang ..... A47B 88/00 211/85.17
2009/0085448 A1 * 4/2009 Zhang ..... B25H 3/00 312/309
2011/0294606 A1 * 12/2011 Llyod ..... A63B 69/0071 473/422
2014/0200102 A1 * 7/2014 Frostino ..... A63B 69/0071 473/447
2015/0328518 A1 * 11/2015 Sagle ..... A63B 69/0071 473/447

* cited by examiner

*Primary Examiner* — Gene Kim
*Assistant Examiner* — Jeffrey Vanderveen
(74) *Attorney, Agent, or Firm* — Gulf Coast Intellectual Property Group

(57) ABSTRACT

A basketball training apparatus that is operable to simulate a defensive player for a user that is practicing their offensive skillset. The basketball training apparatus further includes a housing assembly having a lower portion and an upper portion that are perpendicularly secured. The housing assembly is moveably secured to a mounting block wherein the mounting block is disposed within the lower portion of the housing assembly. The housing assembly is operable to tiltably move from a first upright position to a second position wherein the upper portion is tilted towards the ground. A plurality of blocking members are releasably secured to the upper portion of the housing assembly extending outward therefrom. A visual inhibitor is movably coupled to the upper portion of the housing assembly and extends upwards therefrom. A frame is integrally secured to the mounting block and further includes a base having a wheel assembly.

11 Claims, 4 Drawing Sheets

BASKETBALL TRAINING APPARATUS

FIELD OF THE INVENTION

The present invention relates generally to sports training equipment, more specifically but not by way of limitation a basketball training apparatus that is operable to simulate a defender and provide training for a basketball player.

BACKGROUND

Basketball is a popular sport in many countries and is enjoyed by millions of people. Thousands of individuals regular participate in playing the game whether for school, recreation or professionally. As with any sport, to excel in the game of basketball it is important to regularly practice. Traditional basketball practice involves numerous types of drills ranging from ball handling drills to shooting drills. As is known in the art, the game of basketball requires a player to play both an offensive role and defensive role during the playing of the game.

Currently there are many practice routines and equipment that are focused on improving a players skill for offensive maneuvers such as but not limited to dribbling and shooting. Many individuals will practice together in order to provide a defensive practice element to the routine. One problem with existing practice routines and equipment is that there is limited ability to provide a defensive player simulation. In the absence of another individual, a player is unable to practice a variety of skills wherein during the practice of these skills the simulation of a defensive player is provided. Basketball skills such as but not limited to shooting and dribbling are much more difficult in the presence of a defender. It is desirable to an individual practicing basketball to have provided to them a defender or simulated defender in order to mimic a game situation wherein the defensive simulation provides an enhanced ability to accommodate the scenario in a real game.

Accordingly, there is a need for a basketball training apparatus that provides simulation of a defender so as to improve a players ability to play when playing in a game.

SUMMARY OF THE INVENTION

It is the object of the present invention to provide a basketball training apparatus that is operable to simulate a defensive player.

Another object of the present invention is to provide a basketball training apparatus that is operable to simulate a defensive player wherein the basketball training apparatus includes a housing assembly that has an upper portion and a lower portion.

A further object of the present invention is to provide a basketball training apparatus that provides defensive simulation to a user wherein the housing assembly is movably mounted to a center block assembly that is disposed within the lower portion of the housing assembly.

An additional object of the present invention is to provide a basketball training apparatus that is operable to provide elements of a defensive player wherein the basketball training apparatus includes a plurality of lateral arm members.

Still another object of the present invention is to provide a basketball training apparatus that is operable to provide simulation of a defender wherein the basketball apparatus includes vertical arms members that are operable to simulate the outstretched arms and hands of a defensive player.

Yet a further object of the present invention is to provide a basketball training apparatus operable to provide defensive simulation wherein the upper portion of the housing is engaged by a user and is movable so as to simulate the body of a defensive player.

An additional object of the present invention is to provide a basketball training apparatus that is operable to provide simulation of a defensive player wherein the center block assembly further includes a frame assembly integrally mounted thereto.

Another object of the present invention is to provide a basketball training apparatus that is operable to provide defensive simulation to a user that further includes a pair of adjustment members wherein the adjustment members are adjacent the vertical arm members and are positionable so as to control the movement of the vertical arm members.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
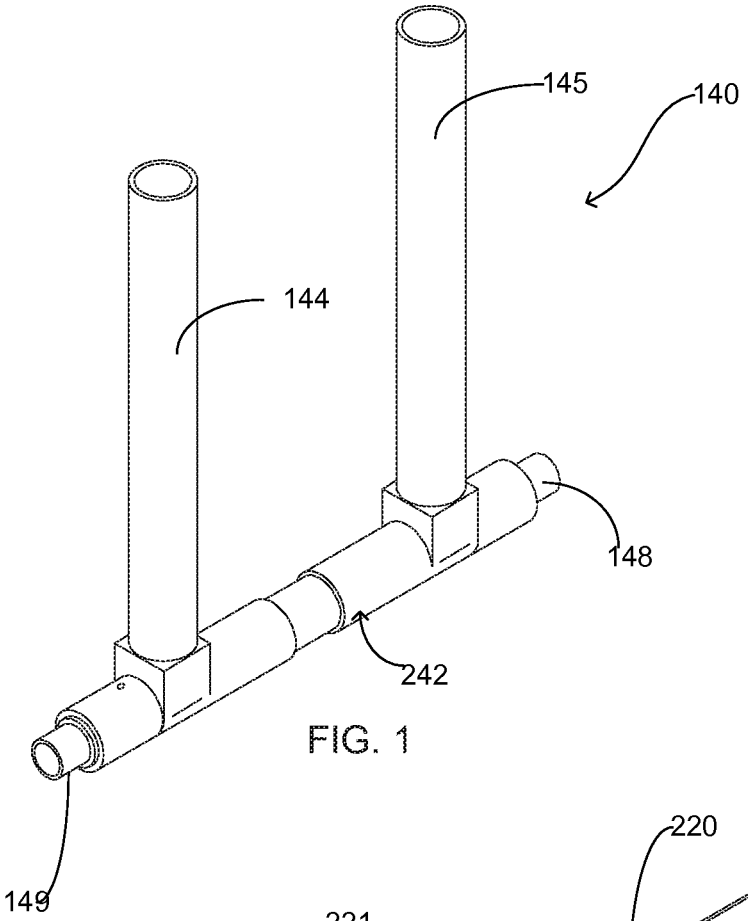
FIG. 1 is a perspective view of the vertical arm member mounting assembly.

Referring now to the drawings submitted herewith, wherein various elements depicted therein are not necessarily drawn to scale and wherein through the views and figures like elements are referenced with identical reference numerals, there is illustrated a basketball training apparatus 100 constructed according to the principles of the present invention.

The basketball training apparatus 100 includes a mounting block 10 that is centrally located within the void 22 of the bottom portion 21 of the housing assembly 20. Integrally mounted within the mounting block 10 is frame 30, which provides structural support and portability. Extending laterally from the upper portion 23 of the housing assembly 20 are a plurality of blocking members 40 which function to simulate a blocking move from a defender. Vertically mounted to the upper portion 23 are the visual inhibitors 50 operable to simulate the hands of a defensive player. The basketball training apparatus 100 is operable to provide a defensive player simulation for the training and improvement of an offensive player's skillset.

Figure 4:
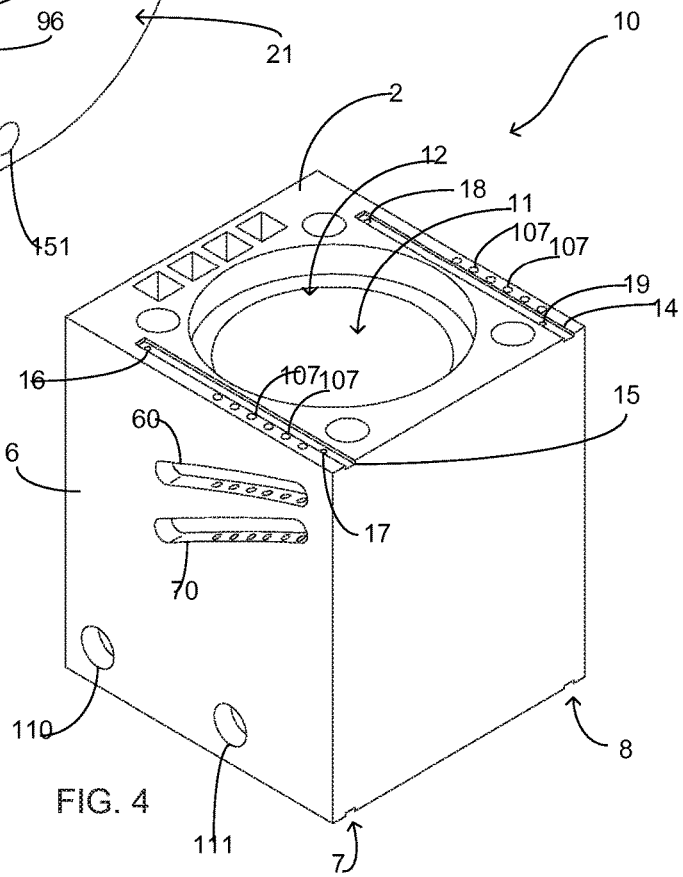
FIG. 4 is a perspective view of the center block assembly of the present invention.

Referring in particular to FIG. 4 herein, the mounting block 10 is illustrated therein. The mounting block 10 is generally square in shape and is manufactured from a suitable durable material such as but not limited to plastic. The mounting block 10 is secured within the void 22 of the bottom portion 21 of the housing assembly 20 wherein the housing assembly 20 is movably secured thereto as is further described herein. The mounting block 10 includes a cavity 11 centrally disposed therein wherein the cavity 11 includes opening 12 providing access thereto. Cavity 12 is operable to receive and store various items such as but not limited to the visual inhibitors 50 when the basketball training apparatus 100 is not in use. The cavity 11 includes lid 13 releasably secured thereto by suitable techniques that is operable to close the opening 12. While a lid 13 is illustrated herein in FIG. 5, it is contemplated within the scope of the present invention that the mounting block 10 could be manufactured either with or without a lid 13. It is contemplated within the scope of the present invention that the mounting block 10 could be manufactured from a series of equally sized plates being arranged in a vertical manner and secured utilizing chemical adhesion or be manufactured utilizing another suitable method such as but not limited to injection molding.

The mounting block 10 further includes recessed upper slots 14,15 that are formed within the upper surface 9 of the mounting block 10 utilizing suitable durable techniques. The recessed upper slots 14,15 are operable to receive therein upper frame members 31, 32. As previously mentioned herein the frame 30 is integrally coupled with the mounting block 10. The mounting block 10 is disposed within void 33 of frame 30. The left vertical support members 34,35 and right vertical support members 36,37 are journaled through left apertures 16,17 and right apertures 18,19 respectively. The left vertical support members 34,35 and right vertical support members 36,37 are journaled completely through the mounting block 10 and are secured to lower frame members 38,39 which are secured within the lower recess slots 7,8. Those skilled in the art will recognize that various chemical and/or mechanical fastening techniques could be utilized to secure the frame 10 to the mounting block 10.

The mounting block 10 further includes upper channel 60 and lower channel 70 that are formed within the side wall 6 of the mounting block 10. The upper channel 60 and lower channel 70 are formed within the mounting block 10 utilizing suitable durable techniques. While not particularly illustrated herein, an additional upper channel and lower channel are identically formed on the opposing sidewall of the mounting block 10. The upper channel 60 and lower channel 70 are formed having a first radius and second radius respectively wherein the radius for the upper channel 60 and lower channel 70 are not equal. The upper channel 60 and lower channel 70 function to movably receive couplings 75,76 respectively wherein the couplings 75,76 are operable to traverse through the upper channel 60 and lower channel 70. The movable couplings 75, 76 and the upper channel 60 and lower channel 70 function to provide the pivotal movement of the housing assembly 20 along the arcuate lower edge 90 of the bottom portion 21 of the housing assembly 10 as is further discussed herein. Couplings 75, 76 include first ends 78 and second ends 79 with first ends 78 being movably secured within the upper channel 60 and lower channel 70 and second ends being journal through apertures 95,96 so as to operably couple the housing assembly 20 to the mounting block 10. While a preferred embodiment of the couplings 75,76 have been disclosed herein, it is contemplated within the scope of the present invention that the housing assembly 20 could be movably secured to the mounting block 10 utilizing numerous different types of fasteners and/or techniques.

The upper channel 60 and lower channel 70 further includes apertures 67 and 77 respectively. Apertures 67, 77 and 107 journaled through the top surface 2 of mounting block 10 are in axial alignment and are operable to receive therethrough pin 87, which is coupled to handle 88. Pin 87 is releasably secured through apertures 67, 77 and 107 and is operable to limit the travel distance of couplings 75,76 and thus the radial movement of the housing assembly 20 along lower edge 90 which affects the distance in which the upper portion 23 will tiltably move in direction Z. Pin 87 is integrally secured to handle 88 and is manufactured from a suitable durable material such as but not limited to plastic or metal. Second ends 78 of couplings 75,76 are manufactured to further include grooves 98,99 respectively wherein the grooves 98,99 are operable to mateably engage the pin 87 providing a more secure engagement therewith.

Figure 6:
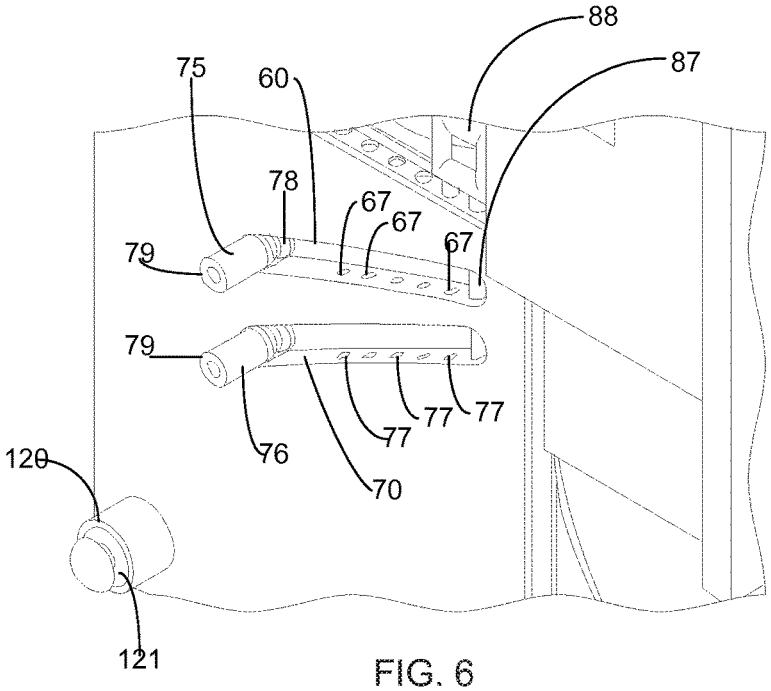
FIG. 6 is a detailed view of the side of the center block assembly of the present invention.

Referring to FIGS. 4 and 6 herein the mounting block 10 includes annular shaped depressions 110,111 formed in the sidewall 6. While not illustrated herein, as with the upper channel 60 and lower channel 70, the opposing side of the mounting block from sidewall 6 further includes annular shaped depressions in the identical location and formed in the same manner. The depressions 110, 111 are operable to receive a portion therein of stop pin 120. Stop pin 120 is secured to the lower portion 21 of housing assembly 20 through bores 150,151 and includes a movable section 121 that includes a first position and a second position. In the first position the movable section 121 is biased inwards towards mounting block 10 so as to maintain the housing assembly 20 in a position such that it is stationary and wherein the upper portion 23 is substantially vertical. This position is utilized when the basketball training apparatus 100 is not in use such as but not limited to shipping or storage. In its second position, the movable section 121 is biased away from the mounting block 10 so as to allow the housing assembly 20 to move with respect to the mounting block 10 as described herein. It is contemplated within the preferred embodiment of the present invention that the basketball training apparatus 100 includes two stop pins 120 mounted on each side of the mounting block 10 but it should be recognized by those skilled in the art that as few as one stop pin 120 could be utilized to achieve the desired functionality as described herein. It is further contemplated within the scope of the present invention that the stop pin 120 could be manufactured with various different elements using alternate techniques in order to execute the desired functionality as described herein.

Figure 7:
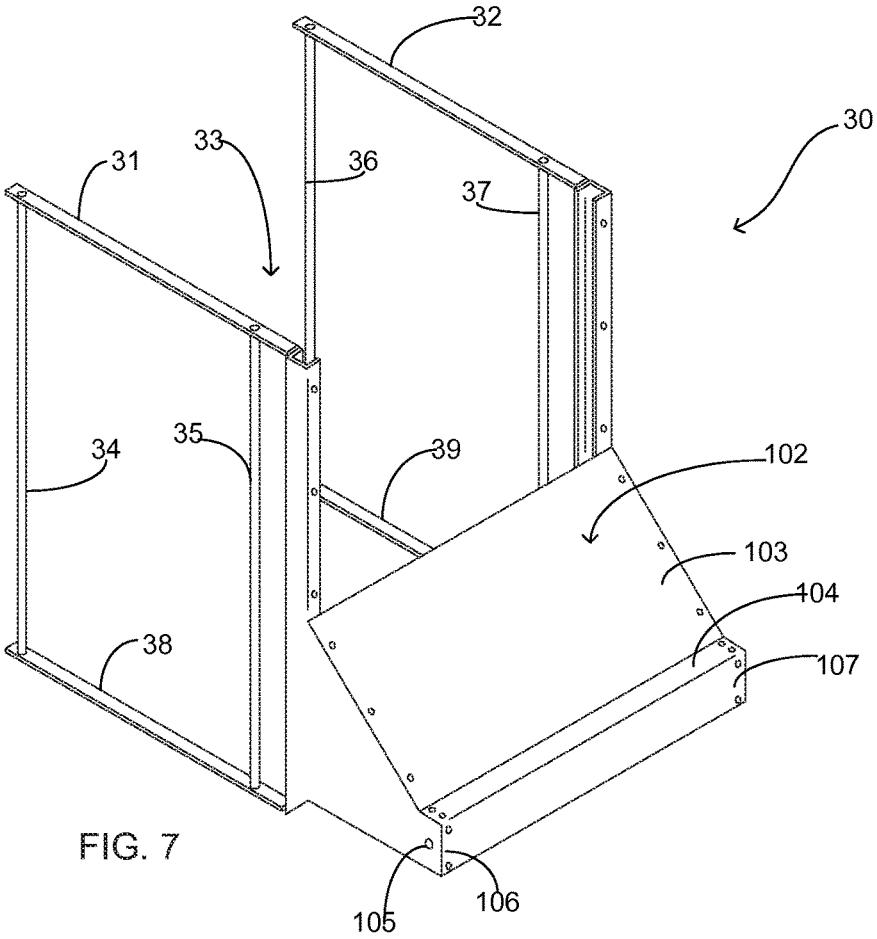
FIG. 7 is a perspective view of the frame assembly of the present invention.

Referring now to FIG. 7 herein, the frame 30 further includes base 102. Base 102 is generally angular in shape having wall 103 and wheel mount 104. Wheel mount 104 is integrally formed with wall 103 and is rectangular in shape having bore 105 journaled therethrough. Bore 105 extends completely through wheel mount 104 extending from first end 106 to second end 107. Wheel mount 104 is operable to receive a wheel assembly which includes wheels 108, 109 and an axle (not illustrated herein). The shape of the base 102 provides the required position for the wheel mount 104 and wheel assembly so as to facilitate the moving of the basketball training apparatus 100. To move the basketball training apparatus to the desired location the user will tilt the housing assembly 20 in the direction of axis z with the stop pins 120 in their first position and the basketball training apparatus 100 will be balanced on the wheels 108,109 so as to be rolled to a desired location. Those skilled in the art will recognize that the frame 30 could be formed having a base 102 constructed of various different elements in numerous different shapes in order to achieve the desired functionality as described herein.

Figure 3:
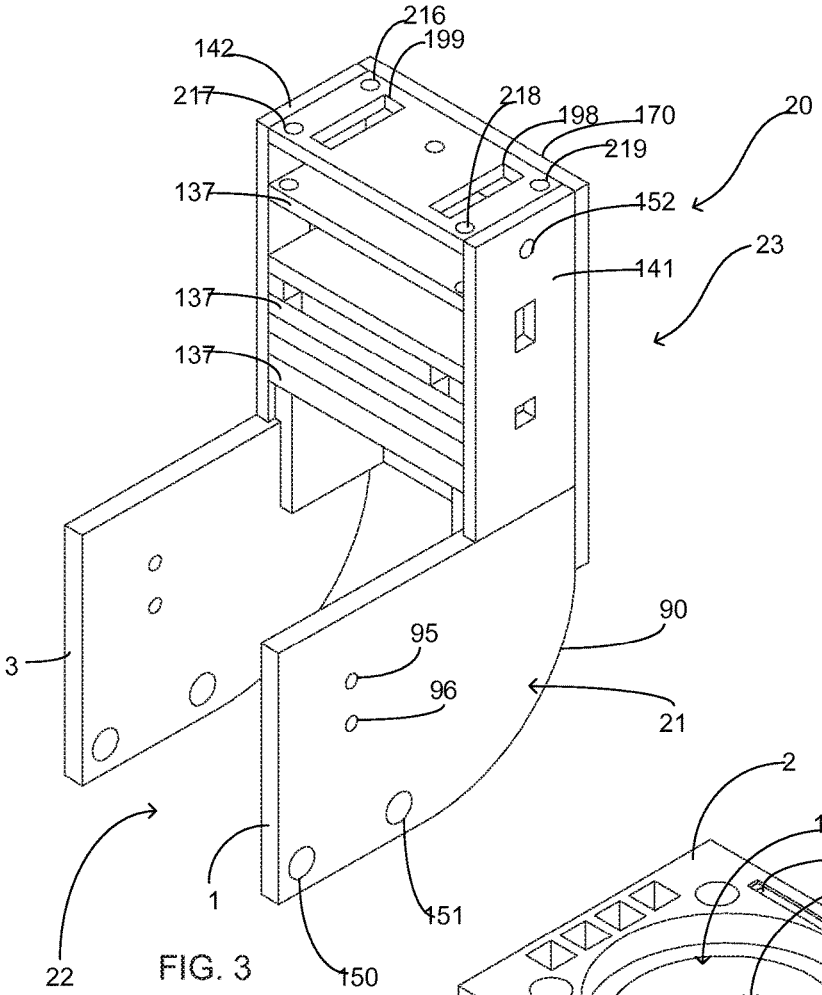
FIG. 3 is a perspective view of the housing of the present invention.
Figure 5:
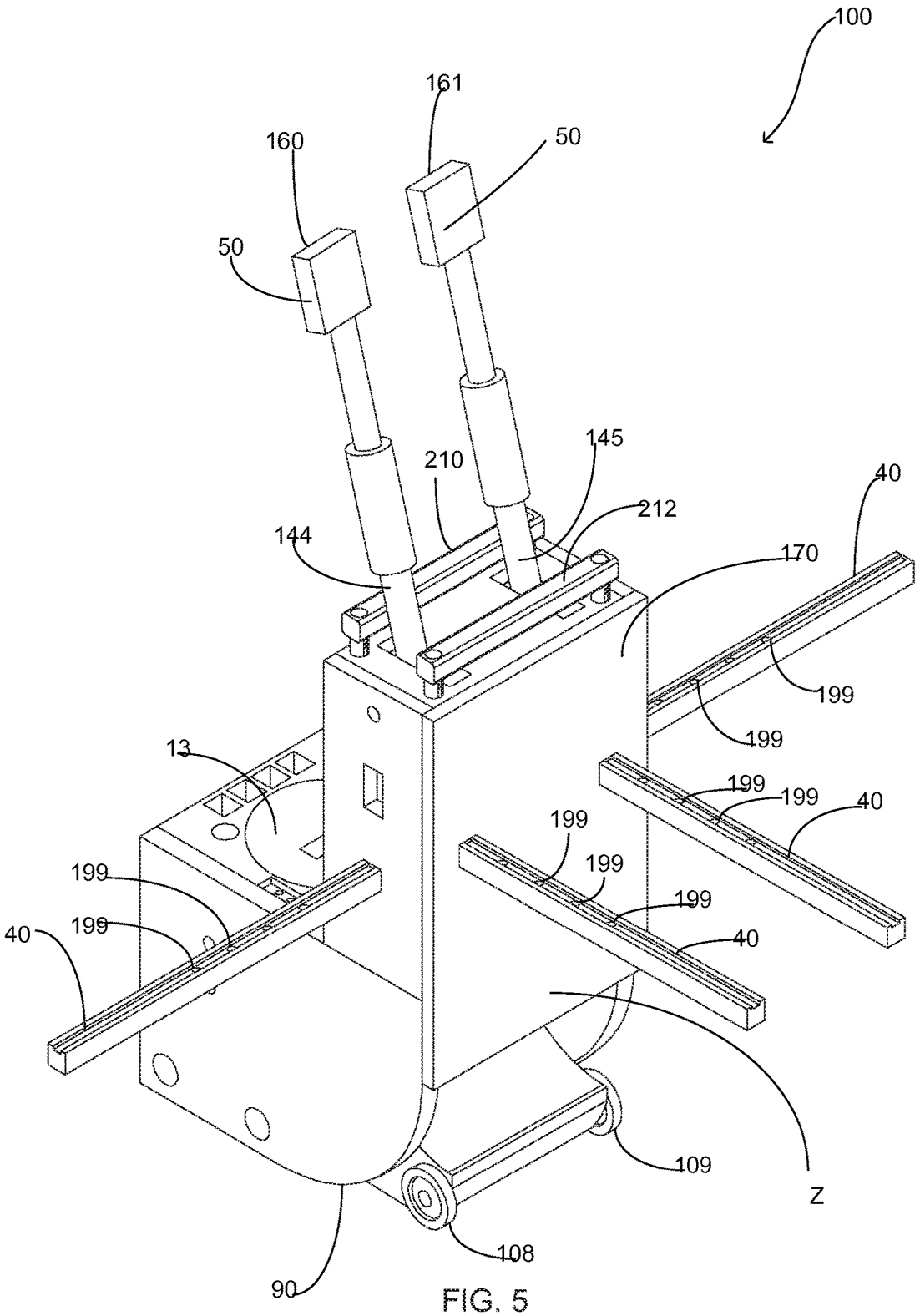
FIG. 5 is a perspective view of the preferred embodiment of the present invention.

Referring now to FIG. 3 herein, the housing assembly 20 is illustrated therein wherein the housing assembly has been illustrated removed from the mounting block 10. As discussed herein, the housing assembly 20 is movably mounted to the mounting block 10 such that the housing assembly 10 radially moves along lower edge 90 such that the upper portion 23 is tilted towards a user. During use a user will engage the upper portion with their upper body so as to bias the upper portion 23 of the housing assembly 20 into an upright position. Subsequently the user will disengage their upper body from the upper portion 23 and as such the upper portion 23 of the housing assembly 20 will move in direction axis Z as shown in FIG. 5. The aforementioned movement occurs when stop pins 120 are in their second position. This movement is designed to imitate an approaching defender and when coupled with the visual inhibitors 50 serves to train an offensive player to improve their play against a defensive player without the need for a defensive player's presence.

The housing assembly 20 includes lower portion 21 and upper portion 23 that are secured in the illustrated configuration utilizing suitable durable techniques. The housing assembly 20 further includes front engagement plate 170 that is secured to the upper portion 23. The front engagement plate 170 provides the necessary surface for a user to bias thereagainst when utilizing the basketball training apparatus 100 as described herein. The upper portion 23 of the housing assembly 20 further includes a plurality of support members 137. Support members 137 extend intermediate vertical members 141,142 and function to provide structural support for the upper portion 23. The lower portion 21 includes members 1, 3 having lower edge 90 being arcuate in manner. Members 1, 3 are secured to vertical members 141, 142 respectively utilizing suitable durable techniques and are coupled therewith to form the housing assembly 20. The upper portion 23 and lower portion 21 are perpendicularly secured so as to provide a generally upright position for the engagement plate 170 when the housing assembly 20 is in its first position. In its second position the housing assembly 20 has rotated downwards along axis Z such that that engagement plate 170 is at an angle that is less than ninety degrees with the ground on which the basketball training apparatus 100 is superposed.

Referring in particular to FIG. 1, the visual inhibitor mount 140 is illustrated therein. The visual inhibitor mount 140 includes arm 242 that is generally rod-shaped being manufactured from a suitable durable material such as but not limited to plastic. The arm 242 includes ends 148, 149 that are smaller in diameter than the arm 142 so as to rotatably engage in aperture 152 and an opposing aperture located in the same position in opposing vertical member 142 (not illustrated herein). The visual inhibitor mount 140 further includes a first support member 144 and a second support member 145. The first support member 144 and second support member 145 extend outward from the arm 242 and through slots 198,199 of the upper portion 23. First support member 144 and second support member 145 function to slidably engage with the visual inhibitors 50. The rotatable mounting of the arm 242 provides the desired back-and-forth movement of the visual inhibitors 50 so as to simulate the moving hands of a defensive basketball player. As the housing assembly 20 moves from its first position to its second position, the arm 242 and the visual inhibitors 50 will rotate in the direction the engagement plate 170 simulating a defensive player's hands moving towards a user. The visual inhibitors 50 includes ends 160,161 that are square in shape and are generally sized to be equivalent to the average human hand. While the visual inhibitor mount 140 is illustrated herein as having a first support member 144 and a second support member 145 it is contemplated that the visual inhibitor mount 140 could only have one support member that would be configured to support either a one or more visual inhibitors 50. Those skilled in the art should recognize that the visual inhibitors 50 could be manufactured having a single base stem operable to couple with a single support member extending from the arm 242. Additionally, it is further contemplated within the scope of the present invention that the ends 160,161 could be formed in numerous different sizes and/or shapes.

Figure 2:
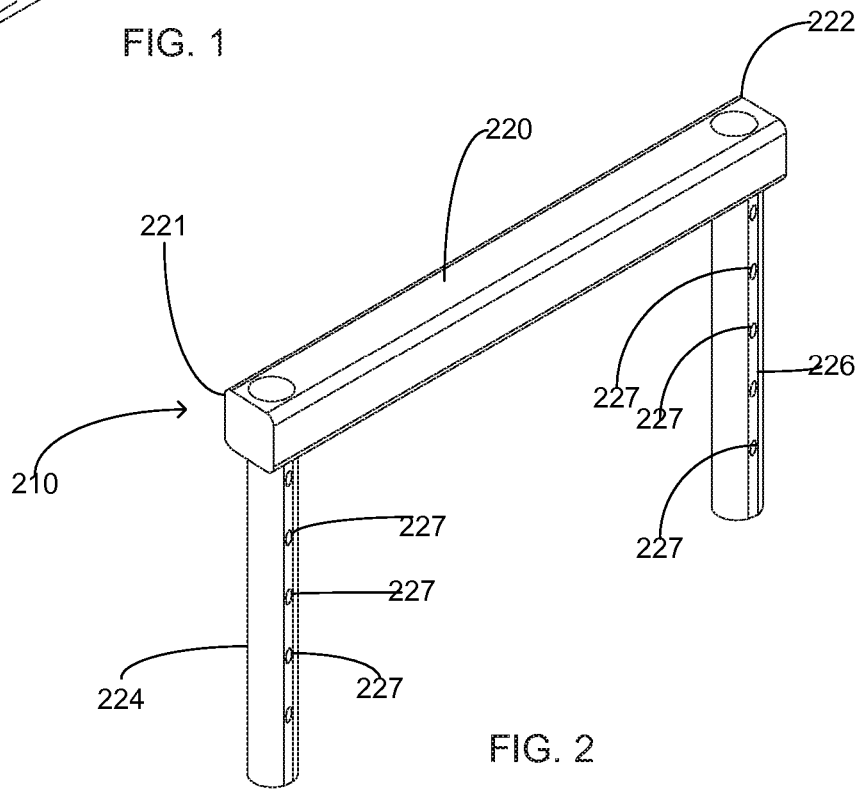
FIG. 2 is a perspective view of an vertical arm member adjustment member of the present invention.

Referring in particular to FIG. 2, a detailed view of the visual inhibitor travel limiter 210 is illustrated therein. A first visual inhibitor travel limiter 210 and a second visual inhibitor travel limiter 212 are movably mounted to the upper portion 23 of the housing assembly 20 in apertures 216,217,218 and 219. The visual inhibitor travel limiter 210 includes upper arm member 220 having a first end 221 and a second end 222. A first vertical support member 224 and a second vertical support member 226 are perpendicularly secured to upper arm member 220. The first visual inhibitor travel limiter 210 and second visual inhibitor travel limiter 212 function to limit the lateral travel of the visual inhibitors 50. The first visual inhibitor travel limiter 210 and second visual inhibitor travel limiter 212 are vertically adjustable via slots 227 wherein slots 227 engage a keeper (not illustrated herein) within the upper portion 23 of the housing assembly 20 so as to secure the first visual inhibitor travel limiter 210 and second visual inhibitor travel limiter 212 in the desired vertical position. It is further contemplated within the scope of the present invention that the slots 227 further include separate color indicia surroundably therearound. The color indicia functions to provide an efficient technique for a user to remember which slot 227 was previously used that produced a desirable movement of the visual inhibitors 50.

Referring again to FIG. 5, the blocking member 40 further include color indicia markings 199. The color indicia markings 199 comprise a plurality of colors wherein the colors are the same on each blocking member 40. As previously discussed herein the blocking member 40 are insertably mounted into the upper portion 23 of the housing assembly 20. The color indicia markings 199 provide a visual means of providing a user an efficient manner of identifying a preferred mounting location for the blocking members 40. It is further contemplated within the scope of the present invention that the basketball training apparatus 100 could utilize a numbering system or other types of indicia to provide the functionality of the color indicia markings 199 as described herein.

What is claimed is:

1. A basketball training apparatus comprising:

a housing assembly, said housing assembly having an upper portion and a lower portion, said upper portion and said lower portion being perpendicular to each other, said lower portion having a first end and a second end, said lower portion proximate said first end having a radius, said housing assembly being manufactured from a rigid material, said housing assembly be movable intermediate a first position and a second position, wherein said upper portion of said housing assembly further includes an engagement plate, said engagement plate operable to be directed towards a user, said engagement plate providing a surface for a user to move said housing assembly from its second position to its first position, wherein said lower portion of said housing assembly further includes at least one aperture journaled therethrough, said lower portion of said housing assembly further including a stop pin, said stop pin operably disposed within said at least one aperture, said stop pin having a first position and a second position, wherein in said first position said stop pin is extended into a hole in said mounting block so as to maintain said housing assembly in said first position;

a mounting block, said mounting block being mounted within said lower portion of said housing assembly, said lower portion of said housing assembly being movably coupled to said mounting block, said mounting block further including an upper channel and a lower channel formed in the opposing sides thereof;

a plurality couplings, said plurality of coupling operable to connect said lower portion of said housing assembly to said mounting block, said upper channel and said lower channel of said mounting block operably connected with said plurality of couplings;

a frame, said frame including vertical support members, upper frame members and lower frame members, said frame being integrally secured to said mounting block, said frame further including a base member, said base member having a wheel assembly;

at least one blocking member, said at least one blocking member being secured to said upper portion of said housing assembly, said at least one blocking member being perpendicular to said upper portion of said housing assembly and extending outward therefrom;

at least one visual inhibitor, said at least one visual inhibitor being movably connected to said upper portion of said housing assembly, said at least one visual inhibitor extending upward from said upper portion of said housing assembly; and wherein the basketball training apparatus is operable to provide a user simulation of a defensive player.

2. The basketball training apparatus as recited in claim 1, wherein the stop pin in said second position is retracted away from said mounting block so as to be disengaged therefrom so as to facilitate the housing assembly movement towards said second position wherein in said second position said upper portion of housing assembly is leaning towards a support surface on which the basketball training apparatus is superposed.

3. The basketball training apparatus as recited in claim 2, and further including first travel limiter and second travel limiter, said first travel limiter and second travel limiter being movably secured to said upper portion of said housing assembly adjacent said at least one visual inhibitor, said first travel limiter and second travel limiter operable to control the back-and-forth movement of said at least one visual inhibitor.

4. A basketball training apparatus that is operable to provide simulation of a defensive player comprising:

a housing assembly, said housing assembly having an upper portion and a lower portion, said lower portion including a first wall and a second wall, said lower portion having a void intermediate said first wall and said second wall, said upper portion and said lower portion being perpendicular to each other, said upper portion having a first wall and a second wall, said first wall and said second wall of said lower portion of said housing assembly having a first end and a second end, said first end of said first wall and said second wall having an arcuate edge, said housing assembly being manufactured from a rigid material, said housing assembly be movable intermediate a first position and a second position, wherein said upper portion of said housing assembly further includes an engagement plate, said engagement plate mounted intermediate said first wall and said second wall of said upper portion of said housing assembly, said engagement plate providing a surface for a player to push against during use of the basketball training apparatus so as to move the housing assembly from its second position towards its first position;

a mounting block, said mounting block being cube shaped having four side, a top and a bottom, said mounting block being mounted within said void of said lower portion of said housing assembly, said lower portion of said housing assembly being movably coupled to said mounting block, said mounting block further including slots formed in said top and said bottom thereof, wherein said mounting block further includes an upper channel and a lower channel formed in the opposing sidewalls thereof adjacent to the first wall and second wall of said lower portion of said housing assembly, said upper channel and said lower channel having a first end and a second end, wherein said mounting block further includes a plurality of apertures, said plurality of apertures being bored through said slots formed on said top and said upper channel and said lower channel, said plurality of apertures being in linear and vertical alignment, said plurality of apertures operable to receive a stop pin therethrough, wherein the stop pin limits the tilt angle of the second position of said housing assembly;

a first pair of couplings and a second pair of couplings, said first pair of couplings operable to movably couple said first wall of said lower portion of said housing assembly to said mounting block, said second pair of couplings operable to movably couple said second wall of said lower portion of said housing assembly to said mounting block;

a frame, said frame including vertical support members, upper frame members and lower frame members, said upper frame members and said lower frame members being disposed within said slots formed in said top and said bottom of said mounting block, said frame being integrally secured to said mounting block, said frame further including a base member, said base member having a wheel assembly;

a plurality of blocking members, said plurality of blocking members being releasably secured to said upper portion of said housing assembly, said plurality of blocking members being perpendicular to said upper portion of said housing assembly and extending outward therefrom and wherein at least one of said plurality of blocking members is perpendicular in orientation to at least one additional blocking member;

a visual inhibitor, said visual inhibitor being movably connected to said upper portion of said housing assembly, said visual inhibitor extending upward from said upper portion of said housing assembly;

a visual inhibitor mount, said visual inhibitor mount having a base member including a first end and a second end, said first end and said second end of said base member being rotatably coupled to said first wall and said second wall of said upper portion of said housing assembly, said visual inhibitor mount further including at least one support member integrally connected to said base member and extending outward therefrom, said at least one support member operably coupled to said visual inhibitor; and wherein the housing assembly of the basketball training apparatus is operable to tiltably move between a first position and a second position during use thereof.

5. The basketball training apparatus as recited in claim 4, and further including first travel limiter and second travel limiter, said first travel limiter and second travel limiter being movably secured to said upper portion of said housing assembly with said visual inhibitor intermediate said first travel limiter and said second travel limiter, said first travel limiter and second travel limiter operable to control the back-and-forth movement of said visual inhibitor.

6. A basketball training apparatus operable to simulate a defensive player for a user practicing offensive skills comprising:

a housing assembly, said housing assembly having an upper portion and a lower portion, said lower portion including a first wall and a second wall, said lower portion having a void intermediate said first wall and said second wall, said upper portion and said lower portion being perpendicular to each other, said upper portion having a first wall and a second wall, said first wall and said second wall of said upper portion being vertical in orientation, said upper portion of said housing assembly further including a plurality of horizontal support members intermediate the first wall and the second wall of said upper portion, said first wall and said second wall of said lower portion of said housing assembly having a first end and a second end, said first end of said first wall and said second wall having an arcuate edge, said housing assembly being manufactured from a rigid material, said housing assembly be tiltably movable intermediate a first position and a second position, wherein in said first position said upper portion of said housing assembly is in an upright position and in said second position said upper portion of said housing assembly is tilted;

a mounting block, said mounting block being cube shaped having four side, a top and a bottom, said mounting block being mounted within said void of said lower portion of said housing assembly, said lower portion of said housing assembly being movably coupled to said mounting block, said mounting block further including slots formed in said top and said bottom thereof, said mounting block further including an interior volume, said interior volume having an opening formed in said top providing access thereto, said mounting block further including an upper channel and a lower channel formed in the opposing sidewalls thereof adjacent to the first wall and second wall of said lower portion of said housing assembly, said upper channel and said lower channel having a first end and a second end;

a frame, said frame including vertical support members, upper frame members and lower frame members, said upper frame members and said lower frame members being disposed within said slots formed in said top and said bottom of said mounting block, said frame being integrally secured to said mounting block, said frame further including a base member, said base member having a wheel assembly;

a plurality of blocking members, said plurality of blocking members being releasably secured to said upper portion of said housing assembly, said plurality of blocking members being perpendicular to said upper portion of said housing assembly and extending outward therefrom and wherein at least one of said plurality of blocking members is perpendicular in orientation to at least one additional blocking member, said plurality of blocking members being adjustably connected to said upper portion of said housing assembly so as to provide variable lengths thereof extending outward from said upper portion of said housing assembly;

a visual inhibitor, said visual inhibitor being movably connected to said upper portion of said housing assembly, said visual inhibitor extending upward from said upper portion of said housing assembly.

7. The basketball training apparatus as recited in claim 6, wherein said upper channel is formed in a first radius and said lower channel is formed having a second radius that is different than said first radius.

8. The basketball training apparatus as recited in claim 7, wherein said mounting block further includes a plurality of apertures, said plurality of apertures being bored through said slots formed on said top and said upper channel and said lower channel, said plurality of apertures being in linear and vertical alignment, said plurality of apertures operable to receive a stop pin therethrough, wherein the stop pin limits the tilt angle of the second position of said housing assembly.

9. The basketball training apparatus as recited in claim 8, wherein said lower portion of said housing assembly further includes at least one aperture journaled therethrough, said lower portion of said housing assembly further including a stop pin, said stop pin operably disposed within said at least one aperture, said stop pin having a first position and a second position, wherein in said first position said stop pin is extended into a hole in said mounting block so as to maintain said housing assembly in said first position wherein the upper portion of the housing assembly is in an upright position.

10. The basketball training apparatus as recited in claim 9, and further including a visual inhibitor mount, said visual inhibitor mount having a base member including a first end and a second end, said first end and said second end of said base member being rotatably coupled to said first wall and said second wall of said upper portion of said housing assembly, said visual inhibitor mount further including at least one support member integrally connected to said base member and extending outward therefrom, said at least one support member operably coupled to said visual inhibitor.

11. The basketball training apparatus as recited in claim 10, and further including first travel limiter and second travel limiter, said first travel limiter and second travel limiter being movably secured to said upper portion of said housing assembly with said visual inhibitor intermediate said first travel limiter and said second travel limiter, said first travel limiter and second travel limiter being vertically movable, said first travel limiter and second travel limiter operable to control the back-and-forth movement of said visual inhibitor.

* * * * *